US011628677B2

(12) United States Patent
Motoyama

(10) Patent No.: US 11,628,677 B2
(45) Date of Patent: Apr. 18, 2023

(54) PRINTING APPARATUS AND PRINTING CONTROL METHOD

(71) Applicant: SEIKO EPSON CORPORATION, Tokyo (JP)

(72) Inventor: Hiroyuki Motoyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/648,998

(22) Filed: Jan. 26, 2022

(65) Prior Publication Data

US 2022/0242146 A1 Aug. 4, 2022

(30) Foreign Application Priority Data

Jan. 29, 2021 (JP) ..... JP2021-012855

(51) Int. Cl.
*B41J 11/46* (2006.01)
*B41J 3/407* (2006.01)
*B41J 11/00* (2006.01)

(52) U.S. Cl.
CPC ..... *B41J 11/46* (2013.01); *B41J 3/4075* (2013.01); *B41J 11/0095* (2013.01)

(58) Field of Classification Search
CPC ..... B41J 11/46; B41J 3/4075; B41J 11/0095
See application file for complete search history.

(56) References Cited

U.S. PATENT DOCUMENTS 9,805,257 B1 * 10/2017 Bozko ..... G07G 5/00
2006/0279624 A1 12/2006 Tsuchiya et al.
2010/0074635 A1 * 3/2010 Sakurai ..... B41J 3/4075 399/16
2011/0292150 A1 * 12/2011 Ishii ..... B41J 3/46 347/110
2018/0009249 A1 * 1/2018 Katsumata ..... B41J 29/38
2019/0287431 A1 * 9/2019 Yamada ..... B41J 11/0075

FOREIGN PATENT DOCUMENTS

JP 2007-015373 1/2007

* cited by examiner

*Primary Examiner* — David H Banh
(74) *Attorney, Agent, or Firm* — Workman Nydegger

(57) ABSTRACT

In sensor determination processing, each of a transmission-type optical sensor and a reflection-type optical sensor detects a label position, and first transport for transporting the printing medium is executed so that a first label position, which is detected by a first sensor succeeding in detecting the label position first, arrives at a printing position. When the first transport is terminated before a second sensor being another sensor succeeds in detecting a label position during the first transport, a first sensor is determined as a sensor to be used for detecting a label position. When the second sensor succeeds in detecting a label position during the first transport, a sensor succeeding in detecting the first label position or a second label position detected by the second sensor, which is closer to the printing position, is determined as the sensor to be used for detecting a label position.

5 Claims, 8 Drawing Sheets

PRINTING APPARATUS AND PRINTING CONTROL METHOD

The present application is based on, and claims priority from JP Application Serial Number 2021-012855, filed Jan. 29, 2021, the disclosure of which is hereby incorporated by reference herein in its entirety.

BACKGROUND

1. Technical Field

The present disclosure relates to a printing apparatus and a printing control method.

2. Related Art

When a printer performs printing on label paper having a plurality of labels arranged at an interval on elongated layout paper, a sensor detects the labels while the label paper is transported, and the detected labels are positioned at printing positions of a printing head. Such positioning processing is also referred to as initial setting processing. Two methods are known for detecting labels for positioning processing. One is a method of detecting, with a transmission-type optical sensor, a switching boundary between a region of layout paper between labels and a region of each label (hereinafter, referred to as a gap detection method), and the other is a method of detecting, with a reflection-type optical sensor, a mark printed in advance correspondingly to a leading edge position of each label on layout paper (hereinafter, referred to as a mark detection method).

As a related art, there is disclosed a printer that determines whether a type of roll paper is die-cut label paper or marked label paper, or neither of them (plain paper), based on a transmitted-light reception level and a reflected-light reception level that are acquired by a combination sensor of a transmission type and a reflection type (JP-A-2007-15373). According to JP-A-2007-15373 described above, when a type of roll paper is die-cut label paper or marked label paper, in other words, when a layout paper portion that cannot be subjected to printing is present on the sensor, a label portion positioned immediately upstream of the layout paper portion is transported under a printing position of the printing head, and a printing start position for self printing is determined.

A user is allowed to set in advance either of the gap detection method or the mark detection method to be employed for detecting labels. There are suitable printing media and unsuitable printing media for each of the detection methods. Thus, when setting of a detection method and a type of a printing medium to be used do not match with each other, labels cannot be detected for positioning processing, and a label detection error is caused. Further, in addition to appropriate setting of a detection method, there has been demanded an idea for preventing an unprinted label from being transported downstream in a transport direction, in other words, an idea for suppressing a label loss as much as possible during positioning processing.

SUMMARY

A printing apparatus for performing printing on a plurality of types of printing media including label paper having a plurality of labels arranged at an interval on elongated layout paper and a mark indicating a position of the label and being formed for each of the plurality of labels, the printing apparatus includes a transport unit configured to transport the printing medium in a transport direction, a printing head configured to perform printing on the printing medium at a predetermined position in the transport direction, a transmission-type optical sensor and a reflection-type optical sensor being arranged at positions upstream of the printing head in the transport direction, the transmission-type optical sensor being configured to detect, as a label position, a boundary between a region of the layout paper where the label is not arranged at the label paper and a region of the label, the reflection-type optical sensor being configured to detect the mark as a label position, and a control unit configured to execute sensor determination processing for determining either of the transmission-type optical sensor or the reflection-type optical sensor as a sensor to be used for detecting a label position for positioning processing, the positioning processing corresponding to transport of the printing medium so that the label is positioned at a printing position of the printing head in the transport direction, and the positioning processing for each of the plurality of labels by controlling the transport unit based on a label position of each of the plurality of labels detected by the sensor determined in the sensor determination processing. In the sensor determination processing, the control unit causes each of the transmission-type optical sensor and the reflection-type optical sensor to detect a label position while causing the transport unit to transport the printing medium, and determines a sensor that succeeds in detecting a label position first as a first sensor and the other sensor as a second sensor, causes the transport unit to perform first transport for transporting the printing medium so that a first label position arrives at the printing position, the first label position being a label position detected by the first sensor, determines the first sensor as a sensor to be used for detecting a label position for the positioning processing when the first transport is terminated before the second sensor succeeds in detecting a label position during the first transport, and determines, as a sensor to be used for detecting a label position for the positioning processing, the first sensor or the second sensor that detects a position closer to the printing position among the first label position and a second label position that is a label position detected by the second sensor, when the second sensor succeeds in detecting a label position during the first transport.

A printing control method for performing printing on a plurality of types of printing media including label paper having a plurality of labels arranged at an interval on elongated layout paper and a mark indicating a position of the label and being formed for each of the plurality of labels, the printing control method includes a transport step for transporting the printing medium in a transport direction, a sensor determining step for determining either of a transmission-type optical sensor or a reflection-type optical sensor being arranged at positions upstream of the printing head in the transport direction, as a sensor to be used for detecting a label position for a positioning step, the positioning step corresponding to transport of the printing medium so that the label is positioned at a printing position of a printing head arranged at a predetermined position in the transport direction, the transmission-type optical sensor being configured to detect, as a label position, a boundary between a region of the layout paper where the label is not arranged at the label paper and a region of the label, the reflection-type optical sensor being configured to detect the mark as a label position, the positioning step for positioning each of the plurality of labels by controlling the transport based on a label position of each of the plurality of labels detected by the sensor determined in the sensor determining step, and a printing step for performing printing on the printing medium with the printing head. In the sensor determining step, each of the transmission-type optical sensor and the reflection-type optical sensor detects a label position while the printing medium is transported, a sensor that succeeds in detecting a label position first is regarded as a first sensor, and the other sensor is regarded as a second sensor, first transport for transporting the printing medium is performed so that a first label position arrives at the printing position, the first label position being a label position detected by the first sensor, when the first transport is terminated before the second sensor succeeds in detecting a label position during the first transport, the first sensor is determined as a sensor to be used for detecting a label position for the positioning step, when the second sensor succeeds in detecting a label position during the first transport, the first sensor or the second sensor that detects a position closer to the printing position, among the first label position and a second label position that is a label position detected by the second sensor, is determined as a sensor to be used for detecting a label position for the positioning step.

DESCRIPTION OF EXEMPLARY EMBODIMENTS

Embodiments of the present disclosure will be described below with reference to the accompanying drawings. Note that each of the drawings is merely illustrative for describing the exemplary embodiment. Since the drawings are illustrative, proportions and shapes may not be precise, match each other, or some may be omitted.

1. Apparatus Configuration

Figure 1:
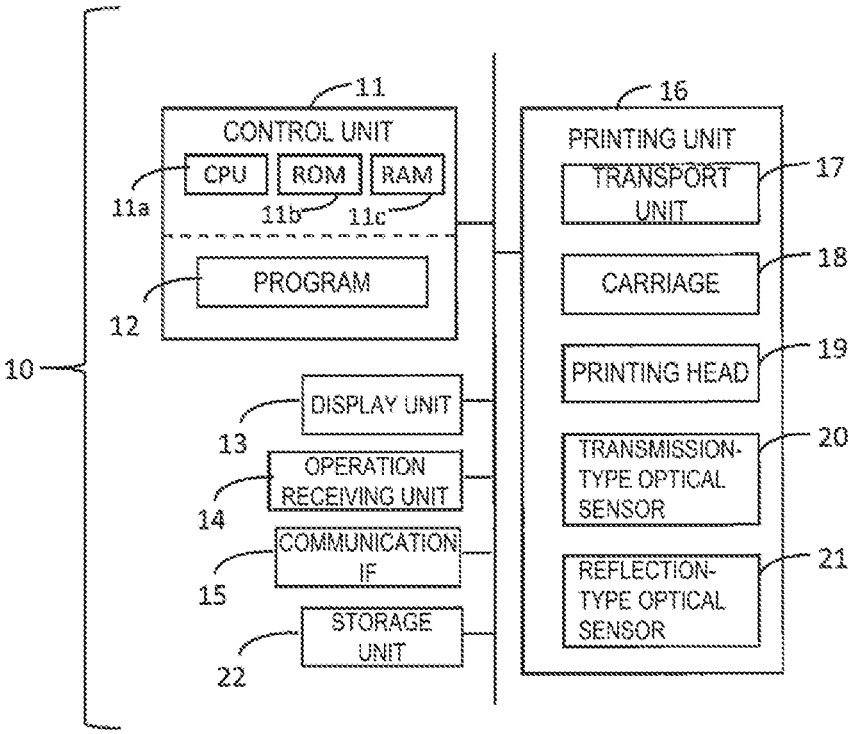
FIG. 1 is a block diagram illustrating an apparatus configuration in a simplified manner.

FIG. 1 illustrates a configuration of a printing apparatus 10 according to the exemplary embodiment, in a simplified manner.

The printing apparatus 10 includes a control unit 11, a display unit 13, an operation receiving unit 14, a communication IF 15, a printing unit 16, a storage unit 22, and the like. The printing unit 16 includes a transport unit 17, a carriage 18, a printing head 19, a transmission-type optical sensor 20, a reflection-type optical sensor 21, and the like. IF is an abbreviation for interface. The control unit 11 is configured to include one or more ICs including a CPU 11*a* as a processor, a ROM 11*b*, a RAM 11*c*, and the like, another non-volatile memory, and the like.

In the control unit 11, the processor, that is, the CPU 11*a* executes arithmetic processing in accordance with one or more programs 12 stored in the ROM 11*b* or other memories, using the RAM 11*c* or the like as a work area. With this, the printing apparatus 10 is controlled. Note that the processor is not limited to the single CPU, and a configuration may be adopted in which the processing is performed by a hardware circuit such as a plurality of CPUs or an ASIC, or a configuration may be adopted in which the CPU and the hardware circuit work in concert to perform the processing.

The display unit 13 is a unit for displaying visual information, and is configured, for example, by a liquid crystal display, an organic EL display, or the like. The display unit 13 may be configured to include a display and a drive circuit for driving the display. The operation receiving unit 14 is a unit for receiving an operation by a user, and is realized, for example, by a physical button, a touch panel, a mouse, a keyboard, or the like. Of course, the touch panel may be realized as a function of the display unit 13.

The display unit 13 and the operation receiving unit 14 may be part of the configuration of the printing apparatus 10, or may be peripheral devices externally coupled to the printing apparatus 10. The communication IF 15 is a generic term for one or a plurality of IFs for coupling the printing apparatus 10 with the outside in a wired or wireless manner, in accordance with a prescribed communication protocol including a known communication standard. For example, the storage unit 22 is a hard disk drive, a solid state drive, other memories, or a storage device. The RAM 11*c* may be considered as a part of the storage unit 22. It may be considered that the storage unit 22 is included in the control unit 11.

For example, the printing unit 16 is a mechanism that performs printing in an inkjet method.

The transport unit 17 is a unit for transporting a printing medium in a predetermined transport direction, and includes, for example, a roller, a motor for rotating the roller, and the like. Upstream and downstream in the transport direction are also simply referred to as upstream and downstream. The printing head 19 includes a plurality of nozzles omitted in illustration. The printing head 19 prints an image at a printing medium by performing ejection or stopping ejection of ink dots from each nozzle, based on printing data for printing the image with ink, the printing data being generated by the control unit 11. The printing head 19 is capable of ejecting a plurality of colors of ink, such as cyan (C) ink, magenta (M) ink, yellow (Y) ink, and black (K) ink. As a matter of course, the printing head 19 may eject ink or liquid having colors other than C, M, Y, and K.

The carriage 18 is a mechanism capable of reciprocating along a predetermined main scanning direction as a result of receiving power from a carriage motor omitted in illustration. The main scanning direction intersects the transport direction. The intersection herein may be understood to be orthogonal or substantially orthogonal. The printing head 19 is mounted on the carriage 18. Specifically, the printing head 19 reciprocates along the main scanning direction together with the carriage 18.

An action of the printing head 19 ejecting ink in accordance with motion of the carriage 18 along the main scanning direction is referred to as main scanning or passing. The printing unit 16 performs printing on a printing medium by combining passing and transporting of the printing medium by a constant amount in the transport direction by the transport unit 17.

The transmission-type optical sensor 20 includes a light-emitting unit and a light-receiving unit that face each other across a transport path through which a printing medium transported by the transport unit 17 passes. The light-receiving unit receives light emitted from the light-emitting unit and detects a transmitted-light amount through the printing medium. The transmission-type optical sensor 20 is a sensor for performing the gap detection method. The reflection-type optical sensor 21 includes a light-emitting unit that is arranged in the transport path, and a light-receiving unit that receives reflected light of light emitted from the light-emitting unit and detects a reflected-light amount through the printing medium. The reflection-type optical sensor 21 is a sensor for performing the mark detection method. Both of the transmission-type optical sensor 20 and the reflection-type optical sensor 21 are arranged upstream of the printing head 19.

The configuration of the printing apparatus 10 illustrated in FIG. 1 may be realized by a single printer, or may be realized by a plurality of communicatively coupled devices.

In other words, the printing apparatus 10 may be the printing system 10 in actuality. For example, the printing system 10 includes a printing control device functioning as the control unit 11 and a printer corresponding to the printing unit 16. A printing control method according to the exemplary embodiment is realized in this way by the printing apparatus 10 or the printing system 10.

Figure 2:
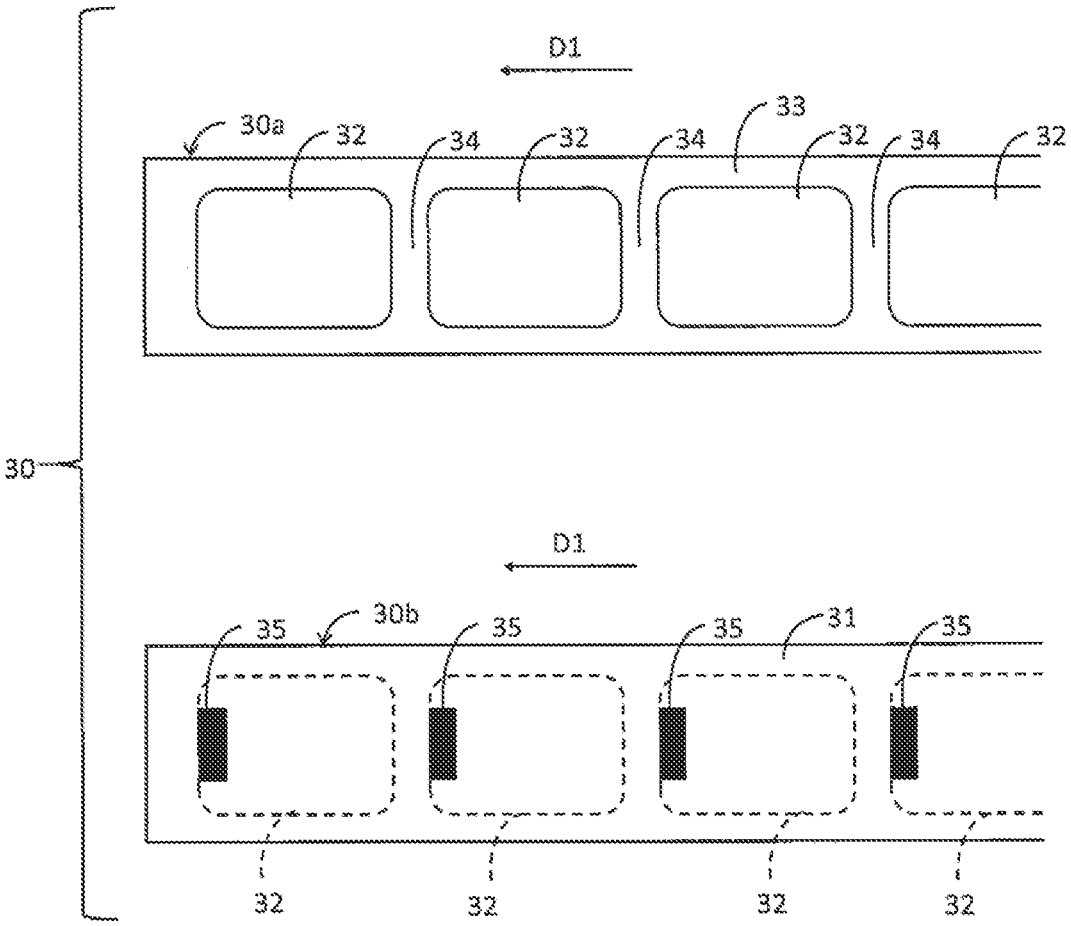
FIG. 2 is a diagram illustrating a front surface and a back surface of label paper.

FIG. 2 illustrates a front surface 30*a* and a back surface 30*b* of label paper 30 at the same time, which is one type of a printing medium. The label paper 30 has elongated layout paper 31 and a plurality of labels 32 adhering on the layout paper 31 with an adhesive. Printing is performed on each label 32. The back surface 30*b* is a surface of the layout paper 31 on which the label 32 do not adhere. The plurality of labels 32 are arranged at a constant interval or a substantially constant interval along a longitudinal direction of the layout paper 31. In FIG. 2, the longitudinal direction of the layout paper 31 and a transport direction D1 match with each other.

A region of the front surface 30*a*, which is other than the labels 32, is referred to as a layout paper region 33. A gap 34 between the label 32 and the label 32 is a part of the layout paper region 33. In the layout paper region 33, a layer formed of the same material as the label 32 (hereinafter, referred to as an excessive material) remains adhering together with the label 32 on the layout paper 31, or is peeled off in advance in some cases. Specifically, the label paper 30 includes a type without the excessive material and a type with the excessive material. When the excessive material is removed, the layout paper 31 itself is exposed in the layout paper region 33.

In the example of FIG. 2, a mark 35 is formed in advance on the back surface 30*b* of the label paper 30. The mark 35 indicates a position of a leading edge of each label 32 present on the front surface 30*a*. The leading edge of the printing medium, the label 32, or the like indicates an edge oriented downstream. The mark 35 has a color different from that of the layout paper 31, and is black, for example. A shape of the mark 35 is only required to be a shape suitable for detection, and is not particularly limited. Note that the label paper 30 may not have the mark 35 as described above depending on its type.

As described above, the label paper 30 that can be used in the printing apparatus 10 includes various types such as a type with the excessive material, a type without the excessive material, a type with the mark 35, and a type without the mark 35. Even when the label paper is used as a term, the material is not limited to paper. For example, a medium formed of a film material may be used. The printing apparatus 10 is capable of performing printing on a printing medium of a type other than label paper, for example, plain paper.

In a case of the label paper 30 without the excessive material, a transmission amount of light differs in the regions of the gap 34 and the label 32 due to a difference in thickness. Therefore, when the label paper 30 without the excessive material is transported, the transmission-type optical sensor 20 can detect, as a label position, a switching boundary between the regions from the gap 34 to the label 32, that is, the leading edge of the label 32, based on a change in transmission amount of light received by the light-receiving unit. Further, when the label paper 30 having the back surface 30*b* with the mark 35 formed thereon is transported, the reflection-type optical sensor 21 can detect, as a label position, a boundary between a color of the layout paper 31 and a color of the mark 35, that is, the leading edge of the label 32, based on a change in reflection amount of light received by the light-receiving unit. Note that the mark 35 may be formed at a position corresponding to the gap 34 on the back surface 30*b*, and thus the reflection-type optical sensor 21 may detect, as the leading edge of the label 32, a boundary between the color of the mark 35 and the color of the layout paper 31. A signal indicating a detection result acquired by each of the transmission-type optical sensor 20 and the reflection-type optical sensor 21 is transmitted to the control unit 11.

2. Printing Control Processing

Figure 3:
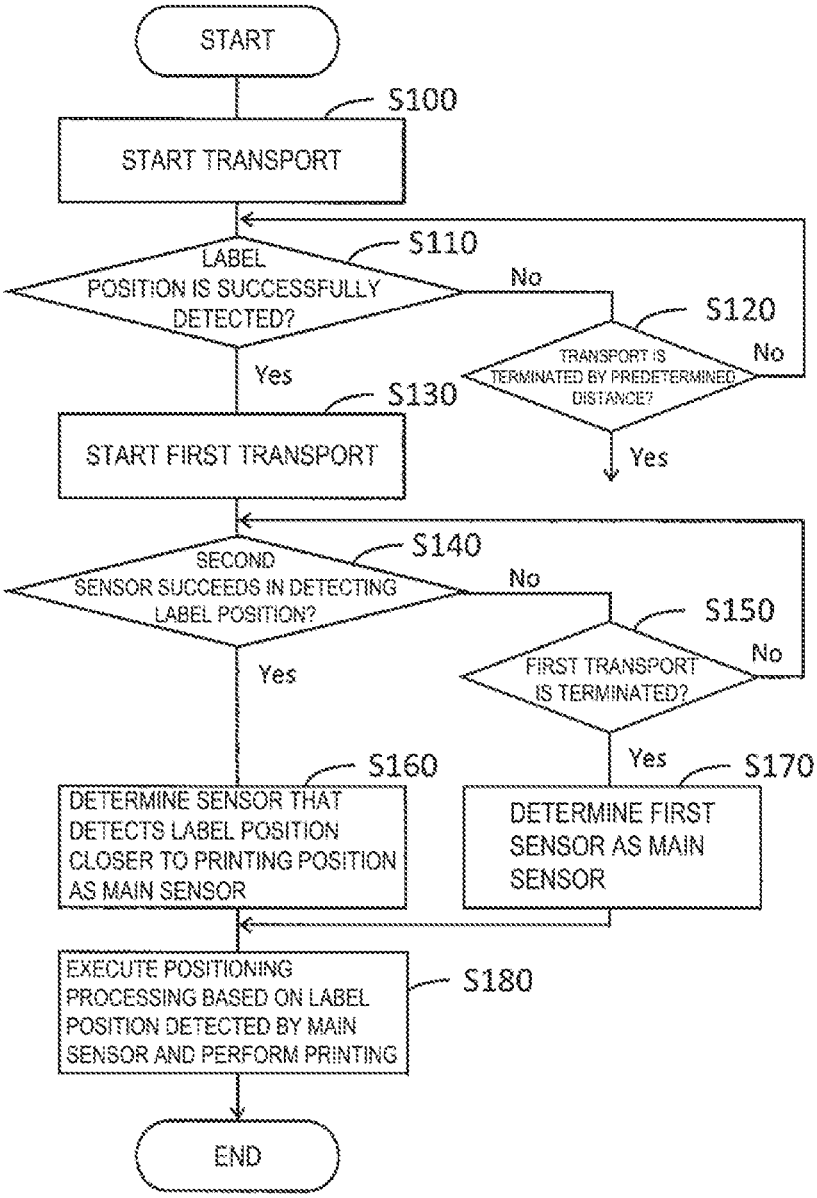
FIG. 3 is a flowchart illustrating printing control processing.

FIG. 3 illustrates, using a flowchart, printing control processing executed by the control unit 11 in accordance with the program 12. The control unit 11 starts the flowchart with setting of the printing medium in the printing apparatus 10 as a trigger. A user stores the printing medium wound in a roll shape at a storage position for the printing medium, which is omitted in illustration, in the printing apparatus 10, and then inserts the leading edge of the printing medium into the transport path to some extent. With this, setting of the printing medium in the printing apparatus 10 is completed. The control unit 11 recognizes setting of the printing medium in the printing apparatus 10 when such completion of the setting is recognized through an input from a user or sensing with a predetermined sensor.

In Step S100, the control unit 11 controls the transport unit 17, thereby starting transport of the printing medium in the transport direction D1. Specifically, a "transport step" is started. Further, with starting of the transport in Step S100 as a trigger, the control unit 11 causes each of the transmission-type optical sensor 20 and the reflection-type optical sensor 21 to start detection of a label position. As described below, Steps S100 to S170 correspond to "sensor determination processing" for determining a sensor to be used for detecting a label position. The sensor determination processing is executed for "positioning processing" in which a label is positioned at a "printing position" of the printing head 19 in the transport direction D1 by transporting the printing medium.

In Step S110, the control unit 11 determines whether either of the transmission-type optical sensor 20 or the reflection-type optical sensor 21 succeeds in detecting a label position. When neither the transmission-type optical sensor 20 nor the reflection-type optical sensor 21 succeeds in detecting a label position, the control unit 11 proceeds to Step S120 based on the determination of "No". Meanwhile, when either of the transmission-type optical sensor 20 or the reflection-type optical sensor 21 succeeds in detecting a label position, the control unit 11 proceeds to Step S130 based on the determination of "Yes".

In Step S120, the control unit 11 determines whether a transport distance of the printing medium after starting the transport in Step S100 reaches a predetermined distance. When the transport distance does not reach the predetermined distance, the control unit 11 returns to Step S110 based on the determination of "No". The predetermined distance herein indicates a transport distance sufficient for either of the transmission-type optical sensor 20 or the reflection-type optical sensor 21 to detect a label position from the printing medium set in the printing apparatus 10, and is determined in advance.

When the transport distance of the printing medium after starting the transport in Step S100 reaches the predetermined distance under while determination of "No" in Step S110 is continuously given, the control unit 11 determines "Yes" in Step S120. When the printing medium is, for example, label paper that has an excessive material but does not have the mark 35 or standard plain paper, determination of "Yes" is given in Step S120. Processing executed when determination of "Yes" is given in Step S120 is described later.

When determination of "Yes" is given in Step S110, the control unit 11 recognizes the transmission-type optical sensor 20 or the reflection-type optical sensor 21, which succeeds in detecting a label position at the moment, as a "first sensor", and recognizes the other sensor as a "second sensor". The first sensor is a "sensor that first succeeds in detecting a label position" among the transmission-type optical sensor 20 and the reflection-type optical sensor 21.

In Step S130, the control unit 11 causes the transport unit 17 to start "first transport" for transporting the printing medium so that a "first label position" being the label position detected by the first sensor at the timing in Step S110 arrives at the printing position. Note that transport of the printing medium is started in Step S100. Thus, the first transport is started during the transport started in Step S100. The transport unit 17 is not required to stop transport motion temporarily between the transport started in Step S100 and the first transport.

In Step S140, the control unit 11 determines whether the second sensor succeeds in detecting a label position. When the second sensor does not succeed in detecting a label position, the control unit 11 proceeds to Step S150 based on the determination "No". Meanwhile, when the second sensor succeeds in detecting a label position, the control unit 11 proceeds to Step S160 based on determination of "Yes". "Yes" in Step S140 indicates that the second sensor succeeds in detecting a label position during the first transport. Note that the label position detected by the second sensor at the timing in Step S140 is referred to as a "second label position".

In Step S150, the control unit 11 determines whether the first transport is terminated. When the first transport is not terminated, the control unit 11 returns to Step S140 based on the determination "No". When the first label position arrives at the printing position while determination of "No" in Step S140 is continuously given, the control unit 11 determines that the first transport is terminated, specifically, determines "Yes" in Step S150. The control unit 11 proceeds to Step S170 based on determination of "Yes" in Step S150. "Yes" in Step S150 indicates that the second sensor fails to detect a label position during the first transport and the first transport is terminated.

In Step S160, the control unit 11 determines the first sensor or the second sensor, which detects the first label position or the second label position closer to the printing position, as a "sensor to be used for detecting a label position for positioning processing". In the following description, a sensor to be used for detecting a label position for positioning processing is referred to as a "main sensor", and a sensor being the first sensor or the second sensor, which is not the main sensor, is referred to as a "sub sensor".

Meanwhile, in Step S170, the control unit 11 determines the first sensor as the main sensor.

Although simply described as Step S180 in FIG. 3, the control unit 11 that determines the main sensor in Step S160 or Step S170 controls the transport unit 17 based on a label position of each label detected by the main sensor, thereby executing positioning processing for each label. The control unit 11 controls the carriage 18 and the printing head 19, thereby performing printing on the positioned label. Step S180 includes a "printing process".

Figure 4:
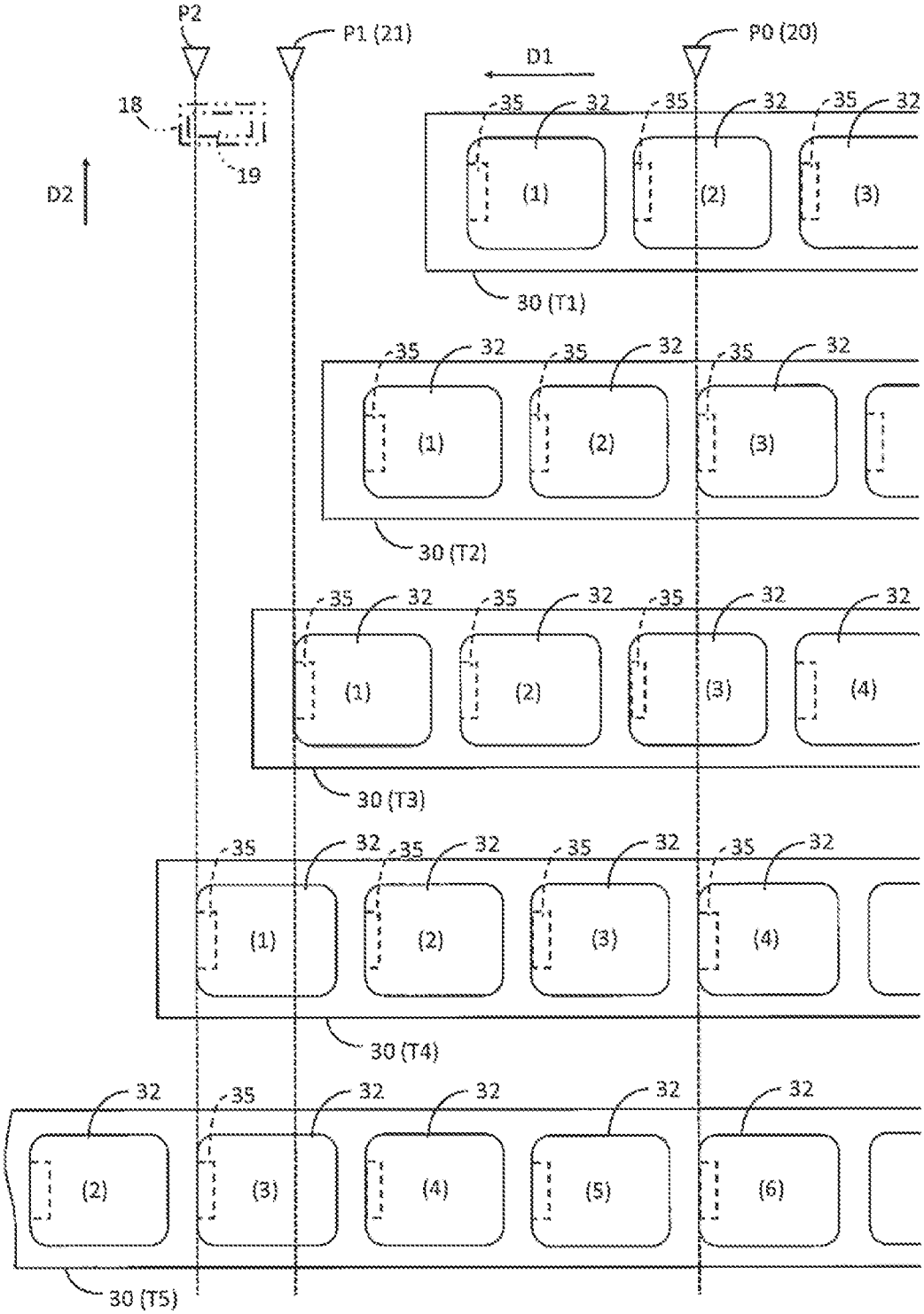
FIG. 4 is a diagram illustrating a state in which the label paper moves downstream in a transport direction in accordance with elapse of time.

Next, the flowchart of FIG. 3 is described in detail with reference to FIG. 4. FIG. 4 illustrates a state in which one sheet of the label paper 30 transported in the transport direction D1 moves downstream in accordance with elapse of time. Specifically, the label paper 30 at each of timings including a time T1, a time T2, a time T3, a time T4 . . . , is illustrated. Note that FIG. 4 illustrates the front surface 30*a* of the label paper 30. It is assumed that the label paper 30 does not have an excessive material and has the mark 35 for each of the labels 32. In FIG. 4, each mark 35 formed on the back surface 30*b* is indicated with a broken line. Further, in FIG. 4, a numerical symbol in parentheses in the region of the labels 32 indicates an order of each label 32 from the leading edge of the label paper 30.

A reference symbol P0 indicates a gap detection position P0 being a position of the transmission-type optical sensor 20 in the transport direction D1. A reference symbol P1 indicates a mark detection position P1 being a position of the reflection-type optical sensor 21 in the transport direction D1. A reference position P2 indicates a printing position P2 of the printing head 19 in the transport direction D1. In FIG. 4, for reference, the printing head 19 and the carriage 18 on which the printing head 19 is mounted are indicated with a two-dot chain line in a simple manner. Further, an arrow with a reference symbol D2 indicates a main scanning direction D2 intersecting the transport direction D1.

In the example of FIG. 4, the transmission-type optical sensor 20 is arranged upstream of the reflection-type optical sensor 21. However, depending on a product, the printing apparatus 10 may have a configuration in which the reflection-type optical sensor 21 is arranged upstream of the transmission-type optical sensor 20. In any case, the control unit 11 has already acquired information relating to the positions P0, P1, and P2 and distances between the positions P0, P1, and P2 in the printing apparatus 10.

The label paper 30 at the time T1 is in a state immediately after a user performs setting in the printing apparatus 10, that is, a printing medium at the time of starting the transport in Step S100. In the example of FIG. 4, at the time point when the label paper 30 is set in the printing apparatus 10, the leading edge of the label paper 30 is present downstream of the gap detection position P0.

After the transport of the label paper 30 is started at the time T1, the leading edge of the third label 32 arrives at the gap detection position P0 at the time T2. At this timing, the transmission-type optical sensor 20 detects the leading edge of the third label 32. Specifically, in the example of FIG. 4, the leading edge of the third label 32 is detected as the first label position at the time T2 ("Yes" in Step S110). As a result, the transmission-type optical sensor 20 that detects the first label position is the first sensor, and the reflection-type optical sensor 21 being the other sensor is the second sensor.

In the example of FIG. 4, the first transport is started from the time T2 (Step S130). Transport from the time T2 to timing at which the leading edge of the third label 32 arrives at the printing position P2 corresponds to the first transport. The control unit 11 is only required to cause the transport unit 17 to perform transport by an amount corresponding to the distance from the gap detection position P0 to the printing position P2, thereby executing the first transport. After starting the first transport, the leading edge of the first label 32 arrives at the mark detection position P1 at the time T3. At this timing, the reflection-type optical sensor 21 being the second sensor detects the leading edge of the first label 32 in accordance with the mark 35 of the first label 32. Specifically, in the example of FIG. 4, the leading edge of the first label 32 is detected as the second label position at the time T3 ("Yes" in Step S140), and the control unit 11 proceeds to Step S160.

Note that each of the transmission-type optical sensor 20 and the reflection-type optical sensor 21 is capable of detecting a change from a state without the printing medium to a state with the printing medium, that is, the leading edge of the printing medium. However, at the leading edge of the printing medium and the leading edge of the label 32, a change degree of a light-receiving amount acquired by the light-receiving unit of each sensor differs. Thus, each sensor is capable of detecting the leading edge of the printing medium and the leading edge of the label 32 in a distinguishable manner.

The leading edge of the first label 32 being the second label position is closer to the printing position P2 with respect to the leading edge of the third label 32 being the first label position. Therefore, in Step S160, the control unit 11 determines, as the main sensor, the reflection-type optical sensor 21 being the second sensor that detects the second label position. At the same time, the transmission-type optical sensor 20 being the first sensor is determined as the sub sensor.

In this manner, in Step S180 after the reflection-type optical sensor 21 is determined as the main sensor, the control unit 11 executes positioning processing based on a label position detected by the reflection-type optical sensor 21. Specifically, the control unit 11 causes the transport unit 17 to transport the label paper 30 so that the label position detected by the reflection-type optical sensor 21 arrives at the printing position P2. Note that the processing of transporting the printing medium until the second label position arrives at the printing position P2 may be referred to as "second transport". In the example of FIG. 4, when the leading edge of the first label 32 is detected as the second label position at the time T3, and the reflection-type optical sensor 21 that detects the second label position is determined as the main sensor, the first transport started at the time T2 is terminated while still ongoing, and the transport is switched to the second transport. As a matter of course, the transport unit 17 is not required to stop transport motion temporarily between the first transport and the second transport.

In the example of FIG. 4, the second transport is started from the time T3, and the second transport is terminated at the time T4 when the leading edge of the first label 32 arrives at the printing position P2. The control unit 11 is only required to cause the transport unit 17 to perform transport by an amount corresponding to the distance from the mark detection position P1 to the printing position P2, thereby executing the second transport. The second transport described above can be understood as first positioning processing based on the label position detected by the main sensor after the printing medium is set in the printing apparatus 10. The control unit 11 causes the printing head 19 to perform printing on the label 32 having a leading edge positioned at the printing position P2. After this, the control unit 11 controls the transport unit 17 so that each of the leading edge of the second label 32, the leading edge of the third label 32, the leading edge of the fourth label 32 . . . that are detected by the main sensor arrives at the printing position P2, thereby executing positioning processing for each of the labels 32 repeatedly.

The lowermost part in FIG. 4 illustrates the label paper 30 at the time T5, assuming that the first positioning processing after setting the printing medium is terminated in a state in which the transmission-type optical sensor 20 is set as the main sensor. When the transmission-type optical sensor 20 is set as the main sensor, positioning processing is executed with the detection of the leading edge of the third label 32 by the transmission-type optical sensor 20 at the time T2 as a trigger. With this, the leading edge of the third label 32 arrives at the printing position P2. As a result, the first label 32 and the second label 32 are not subject to printing, and are transported downstream of the printing head 19. Thus, a loss of the labels 32 is caused.

In view of this, in the present exemplary embodiment, when each of the transmission-type optical sensor 20 and the reflection-type optical sensor 21 succeeds in detecting a label position after setting the printing medium, the control unit 11 determines, as the main sensor, either of the sensors that detects a label position closer to the printing position P2, the label position being the first label position or the second label position. As a result, as can be understood from the description of FIG. 3 and FIG. 4, printing can be started on the label paper 30 not at the time T5 but at the time T4, and a loss of the labels 32 can be suppressed.

Here, it is assumed that the mark detection position P1 is arranged at a position closer to the gap detection position P0 with respect to the position illustrated in FIG. 4. In this case, after starting the transport in Step S100, the reflection-type optical sensor 21 may detect the leading edge of the label 32 before the transmission-type optical sensor 20 in some cases. When the reflection-type optical sensor 21 detects the leading edge of the label 32 before the transmission-type optical sensor 20, the reflection-type optical sensor 21 is the first sensor, and the transmission-type optical sensor 20 is the second sensor. In this case, the label position detected by the reflection-type optical sensor 21 (the first label position) is closer to the printing position P2 with respect to the label position detected by the transmission-type optical sensor 20 later (the second label position). Thus, in the end, the reflection-type optical sensor 21 is the main sensor, and an effect of suppressing a loss of the labels 32 can be obtained.

Further, in contrast to FIG. 4, there may be adopted a configuration in which the mark detection position P1 is arranged upstream of the gap detection position P0. In this case, in accordance with the distance between the mark detection position P1 and the gap detection position P0 and the like, the reflection-type optical sensor 21 may be the first sensor, or the transmission-type optical sensor 20 may be the first sensor. In Step S160, the transmission-type optical sensor 20 present relatively downstream is determined as the main sensor, and hence an effect of suppressing a loss of the labels 32 can be obtained similarly to the description given above.

Note that, when the label paper 30 illustrated in FIG. 4 is a type without the mark 35, the first transport is terminated while the reflection-type optical sensor 21 being the second sensor fails to detect the leading edge of the label 32 after the transmission-type optical sensor 20 detects the leading edge of any one of the labels 32 as the first label position after starting the transport in Step S100. In this case, in Step S170, the transmission-type optical sensor 20 being the first sensor is determined as the main sensor. Further, when the label paper 30 illustrated in FIG. 4 is a type having an excessive material, the first transport is terminated while the transmission-type optical sensor 20 being the second sensor fails to detect the leading edge of the label 32 after the reflection-type optical sensor 21 detects the leading edge of any one of the labels 32 as the first label position in accordance with the mark 35 after starting the transport in Step S100. In this case, in Step S170, the reflection-type optical sensor 21 being the first sensor is determined as the main sensor.

When the main sensor is determined in Step S170, as a result, the first transport corresponds to the first positioning processing based on the label position detected by the main sensor after the printing medium is set in the printing apparatus 10. As described above, in the present exemplary embodiment, a sensor suitable for detecting a label position on the label paper 30 is determined as the main sensor, in accordance with the label paper 30 set in the printing apparatus 10. Determination of the main sensor corresponds to setting of the detection method for a label.

3. Processing when Label Position cannot be Detected

Figure 5:
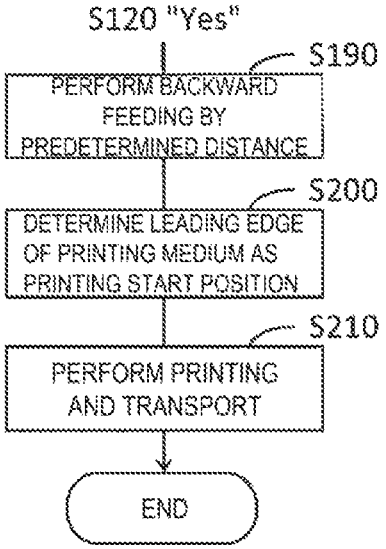
FIG. 5 is a flowchart illustrating one example of processing after determination of "Yes" in Step S120.
Figure 6:
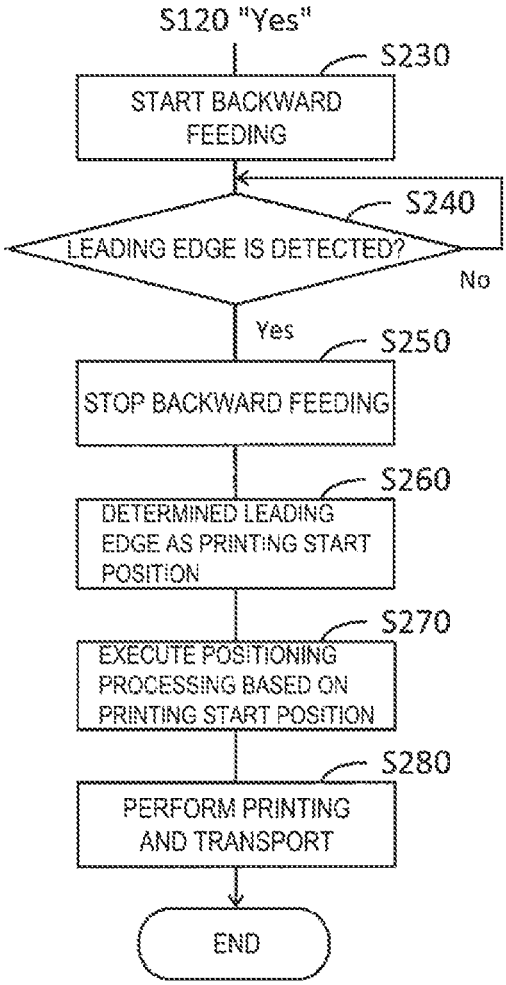
FIG. 6 is a flowchart illustrating another example of processing after determination of "Yes" in Step S120.

With reference to FIG. 5 and FIG. 6, description is made on processing to be executed when determination of "Yes" is given in Step S120, specifically, processing to be executed when neither the transmission-type optical sensor 20 nor the reflection-type optical sensor 21 detects a label position even though the printing medium is transported by a predetermined distance after starting the transport in Step S100. Each of FIG. 5 and FIG. 6 illustrates processing after determination of "Yes" is given in Step S120 in a flowchart. The control unit 11 may execute either of the flowcharts in FIG. 5 or FIG. 6.

First, FIG. 5 is described. In Step S190, the control unit 11 controls the transport unit 17 to transport the printing medium in a direction opposite to the transport direction D1, that is, from downstream to upstream by a predetermined distance. Transport in the direction opposite to the transport direction D1 is referred to as backward feeding. Here, the predetermined distance determined in Step S120 is referred to as a first predetermined distance, and the predetermined distance by which backward feeding is performed in Step S190 is referred to as a second predetermined distance. It may be understood that the first predetermined distance>the second predetermined distance. The second predetermined distance is a distance required for the leading edge of the printing medium to arrive at a position facing the printing head 19. The position of the leading edge of the printing medium is stored in the storage unit 22, and a value thereof is updated every time the printing medium is transported. The position of the leading edge of the printing medium may be detected by the transmission-type optical sensor 20 or the reflection-type optical sensor 21. Alternatively, another sensor capable of detecting the leading edge of the printing medium may be provided. As a result of backward feeding in Step S190, the printing medium is stopped when the position of the leading edge thereof is at the position facing the printing head 19.

In Step S200, the control unit 11 determines the position of the printing medium (the leading edge of the printing medium) facing the printing head 19 as a "printing start position" of the printing medium when backward feeding in Step S190 is terminated. In this case, the printing start position is determined, and then the sensor determination processing is completed. Both of the transmission-type optical sensor 20 and the reflection-type optical sensor 21 are capable of detecting presence or absence of the printing medium. Therefore, a position at which a state without the printing medium is changed to a state with the printing medium can be recognized as the leading edge of the printing medium.

In Step S210 being the subsequent step, the control unit 11 controls transport performed by the transport unit 17 with the printing start position as a reference, and controls the carriage 18 and the printing head 19 to perform printing on the printing medium at the same time. Specifically, in the following steps, the control unit 11 is only required to control transport performed by the transport unit 17, the carriage 18, and the printing head 19 so that printing based on printing data is performed on a region of the printing medium upstream of the leading edge of the printing medium.

Next, FIG. 6 is described. In Step S230, the control unit 11 controls the transport unit 17 to start backward feeding of the printing medium. After backward feeding, the control unit 11 determines either of the transmission-type optical sensor 20 or the reflection-type optical sensor 21 detects the leading edge of the printing medium (Step S240).

When either of the transmission-type optical sensor 20 or the reflection-type optical sensor 21 detects the leading edge of the printing medium, the control unit 11 determines "Yes" in Step S240, and stops backward feeding performed by the transport unit 17 in Step S250.

In Step S260, the control unit 11 determines the leading edge of the printing medium, which is detected at timing of Step S240, as the "printing start position" of the printing medium. In this case, the printing start position is determined, and then the sensor determination processing is completed.

In Step S270, the control unit 11 controls the transport unit 17, thereby executing positioning processing based on the printing start position. Specifically, when the transmission-type optical sensor 20 detects the leading edge of the printing medium in Step S240, the control unit 11 is only required to cause the transport unit 17 to perform transport by an amount corresponding to a distance from the gap detection position P0 to the printing position P2 in Step S270. In contrast, when the reflection-type optical sensor 21 detects the leading edge of the printing medium in Step S240, the control unit 11 is only required to cause the transport unit 17 to perform transport by an amount corresponding to a distance from the mark detection position P1 to the printing position P2 in Step S270.

In Step S280 being the subsequent step, the control unit 11 controls transport performed by the transport unit 17 with the printing start position as a reference, and controls the carriage 18 and the printing head 19 to perform printing on the printing medium at the same time. Specifically, in the following steps, the control unit 11 is only required to control transport performed by the transport unit 17, the carriage 18, and the printing head 19 so that printing based on printing data is performed on a region upstream of the leading edge of the printing medium being the printing start position when the positioning processing in Step S270 is completed.

4. Control Processing Relating to Changing of Main Sensor

Even after the control unit 11 automatically determines either of the first sensor or the second sensor as the main sensor and the other one as the sub sensor in Step S160, a user is allowed to change a sensor, which is to be used for detecting a label position for the positioning processing, from the main sensor to the sub sensor at any timing. Such instruction for the change is referred to as a main sensor change instruction. A user may operate the operation receiving unit 14, thereby inputting the main sensor change instruction to the control unit 11. Note that reflection of the change for the sensor to be used for detecting a label position for the positioning processing is limited to timing when the leading edge of the label 32 is positioned at the printing position P2, and the change is not reflected while the printing medium is transported.

In view of possibility that the main sensor change instruction is received from a user, the control unit 11 updates each of "first position management information" and "second position management information" in accordance with transport of the printing medium, and stores the information in the storage unit 22 at the same time. The first position management information is information of a relative position in the transport direction D1 between the main sensor and each label position detected for each of the labels 32 by the main sensor, and the second position management information is information of a relative position in the transport direction D1 between the sub sensor and each label position detected for each of the labels 32 by the sub sensor. In the positioning processing after determining the main sensor, the control unit 11 controls the transport unit 17 so that the most downstream label position among the label positions upstream of the printing position P2 arrives at the printing position P2, based on the first position management information. In the positioning processing after receiving the main sensor change instruction, the control unit 11 controls the transport unit 17 so that the most downstream label position among the label positions upstream of the printing position P2 arrives at the printing position P2, based on the second position management information.

Control processing regarding such main sensor change is described with reference to FIG. 7.

Figure 7:
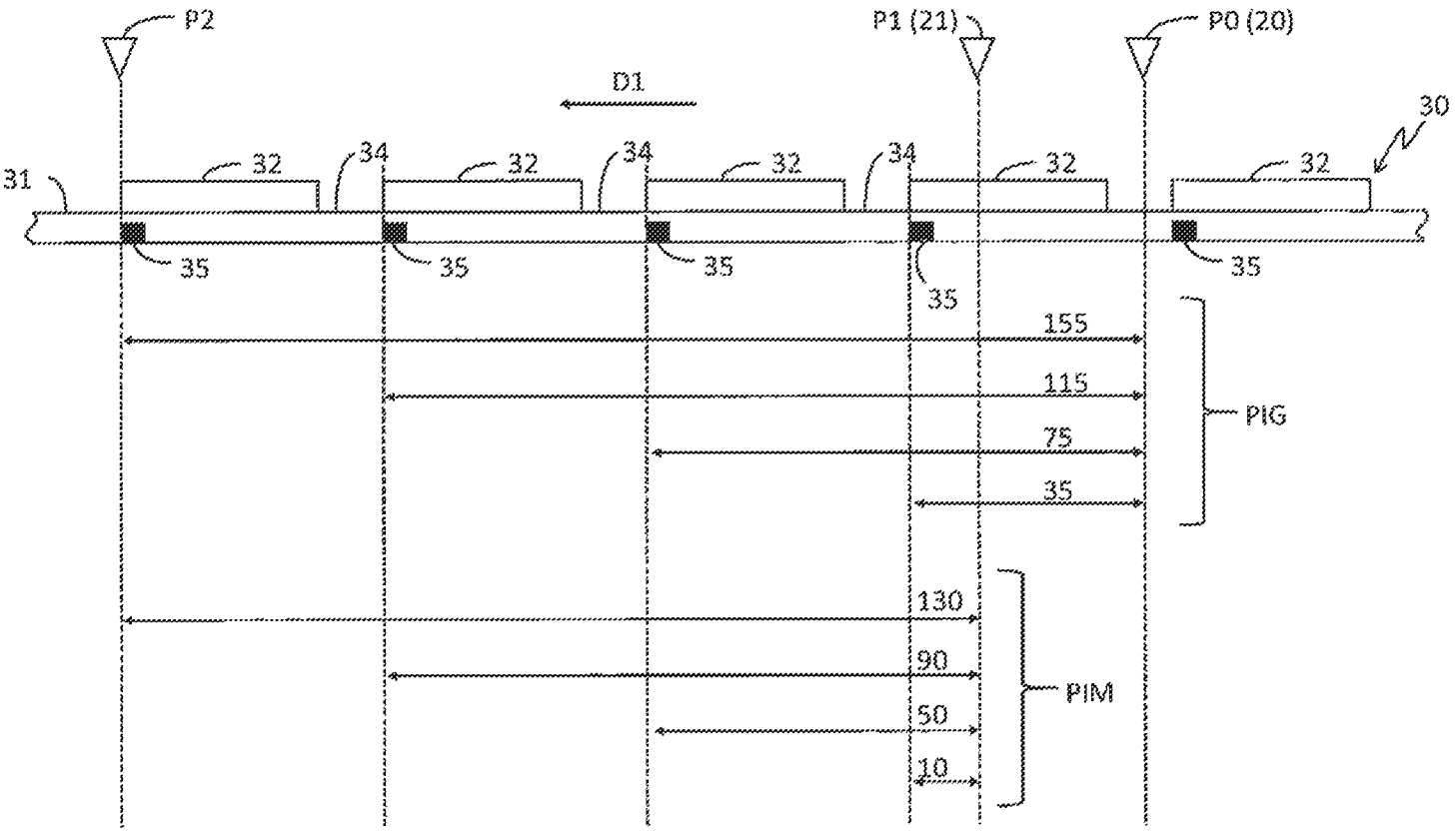
FIG. 7 is a diagram describing control processing relating to changing of a main sensor.

FIG. 7 illustrates the label paper 30 transported in the transport direction D1 from a side viewpoint. As described also in FIG. 2, the label paper 30 has the layout paper 31 and the plurality of labels 32 having the gap 34 therebetween in the transport direction Dl. The label paper 30 illustrated in FIG. 7 does not have an excessive material in the gap 34, and has the mark 35 for each of the labels 32 on the layout paper 31. Thus, the leading edge of each of the labels 32 can be detected by both the transmission-type optical sensor 20 and the reflection-type optical sensor 21.

In the example of FIG. 7, similarly to FIG. 2, the gap detection position P0 is also present upstream of the mark detection position P1. When the leading edge of the label 32 passes through the gap detection position P0, the transmission-type optical sensor 20 detects the leading edge. Therefore, the control unit 11 stores, in the storage unit 22, a current position at which the leading edge of each of the labels 32 detected by the transmission-type optical sensor 20 is present downstream of the gap detection position P0, while updating the position in accordance with progress of the transport of the label paper 30. The relative position thus stored is position management information PIG. In FIG. 7, as the position management information PIG, relative positions "155", "115", "75", and "35" are stored for four labels 32 that are currently present downstream of the gap detection position P0 and are not yet subjected to printing by the printing head 19. Note that a unit indicating the relative positions may be a millimeter or another unit. In FIG. 7, the relative position "155" in the position management information PIG is a distance from the gap detection position P0 to the printing position P2.

Similarly, when the leading edge of the label 32 passes through the mark detection position P1, the reflection-type optical sensor 21 detects the leading edge. Therefore, the control unit 11 stores, in the storage unit 22, a current position at which the leading edge of each of the labels 32 detected by the reflection-type optical sensor 21 is present downstream of the mark detection position P1, while updating the position in accordance with progress of the transport of the label paper 30. The relative position thus stored is position management information PIM. In FIG. 7, as the position management information PIM, relative positions "130", "90", "50", and "10" are stored respectively for four labels 32 that are currently present downstream of the mark detection position P1 and are not yet subjected to printing by the printing head 19. In FIG. 7, the relative position "130" in the position management information PIM is a distance from the mark detection position P1 to the printing position P2.

In the description of FIG. 7, it is assumed that the reflection-type optical sensor 21 is the main sensor and the transmission-type optical sensor 20 is the sub sensor. Therefore, the position management information PIM is the first position management information, and the position management information PIG is the second position management information. The control unit 11 executes the positioning processing based on the position management information PIM as the first position management information. Specifically, the control unit 11 specifies the most downstream relative position among the relative positions of the labels 32 present upstream of the printing position P2 with reference to the position management information PIM, and controls the transport unit 17 so that the relative position of the label 32 arrives at the printing position P2. Note that, among the labels 32 at the relative positions present upstream of the printing position P2, which can be specified with reference to the position management information, the most downstream label 32 is referred to as a "positioning target label".

In FIG. 7, the label 32 at the relative position "130" indicated in the position management information PIM is positioned at the printing position P2, and is a preceding positioning target label. Therefore, after the state illustrated in FIG. 7, the control unit 11 starts printing on the label 32 after this positioning. After printing is completed, the label 32 subsequent to the label 32 after printing, that is, the label 32 at the relative position "90" indicated in the position management information PIM is regarded as a subsequent positioning target label, and the transport unit 17 transports the label paper 30 so that the subsequent positioning target label arrives at the printing position P2.

Here, in the state illustrated in FIG. 7, it is assumed that the control unit 11 receives the main sensor change instruction. The control unit 11 receives the main sensor change instruction, and then executes the positioning processing based on the second position management information, that is, the position management information PIG. In FIG. 7, the label 32 at the relative position "155" indicated in the position management information PIG is positioned at the printing position P2, and corresponds to a preceding positioning target label. Therefore, the control unit 11 starts printing on the label 32 after this positioning. The transport unit 17 is then caused to transport the label paper 30 so that the label 32 subsequent to the label 32 after printing, that is, the label 32 at the relative position "115" indicated in the position management information PIG (the subsequent positioning target label) arrives at the printing position P2.

As it can be understood from FIG. 7, the label 32 at the relative position "90" indicated in the position management information PIM and the label 32 at the relative position "115" indicated in the position management information PIG correspond to the same label 32. Therefore, even when the position management information referred to for the positioning processing is switched from the position management information PIM to the position management information PIG and vice versa with the main sensor change instruction as a trigger, the control unit 11 is capable of executing the positioning processing with the same label 32 as the positioning target label.

Figure 8:
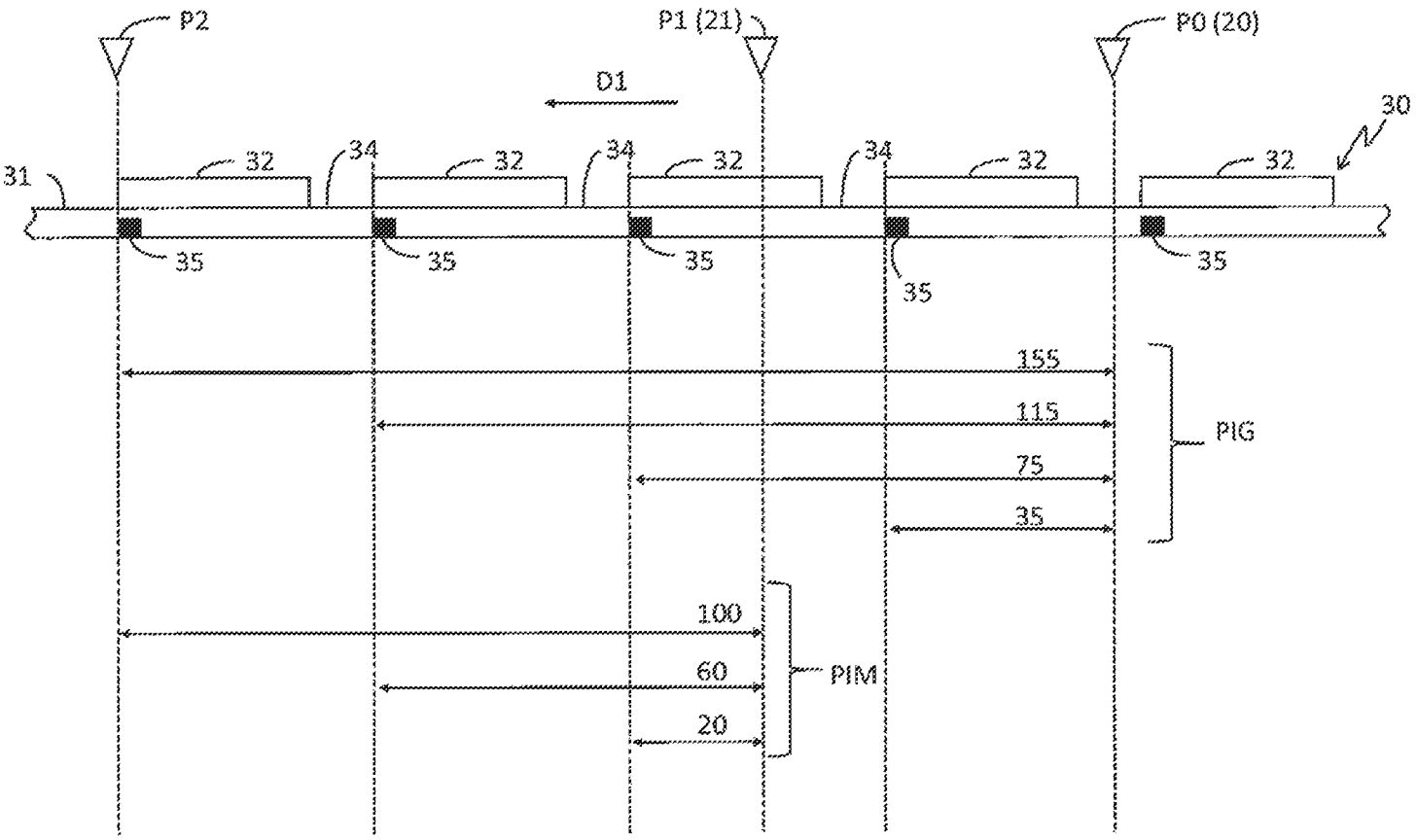
FIG. 8 is a diagram describing control processing relating to changing of a main sensor, which is an example different from FIG. 7.

With reference to FIG. 8, the control processing relating to the main sensor change is further described. The angle of FIG. 8 is similar to the angle of FIG. 7. When FIG. 8 is compared to FIG. 7, the mark detection position P1 is present more downstream. Thus, a distance between the gap detection position P0 and the mark detection position P1 is longer than a distance equal to a sum of one label 32 and one gap 34 on the label paper 30. In the configuration of FIG. 8 as described above, after the label paper 30 is set in the printing apparatus 10 and transport thereof is started, the leading edge of the first label 32 detected by the reflection-type optical sensor 21 and the leading edge of the first label 32 detected by the transmission-type optical sensor 20 are different from each other.

In FIG. 8, similarly to FIG. 7, as the position management information PIG, relative positions "155", "115", "75", and "35" are stored for four labels 32 that are currently present downstream of the gap detection position P0 and are not yet subjected to printing by the printing head 19. Further, as the position management information PIM, relative positions "100", "60", and "20" are stored respectively for three labels 32 that are currently present downstream of the mark detection position P1 and are not yet subjected to printing by the printing head 19. Note that the relative position "100" in the position management information PIM in FIG. 8 is a distance from the mark detection position P1 to the printing position P2.

In the description of FIG. 8, it is also assumed that the reflection-type optical sensor 21 is the main sensor and the transmission-type optical sensor 20 is the sub sensor. Therefore, the position management information PIM is the first position management information, and the position management information PIG is the second position management information. In FIG. 8, the label 32 at the relative position "100" indicated in the position management information PIM is positioned at the printing position P2, and is a preceding positioning target label. Therefore, after the state illustrated in FIG. 8, the control unit 11 starts printing on the label 32 after this positioning. The label 32 subsequent to the label 32 after printing, that is, the label 32 at the relative position "60" indicated in the position management information PIM is regarded as a subsequent positioning target label, and the transport unit 17 transports the label paper 30 so that the subsequent positioning target label arrives at the printing position P2.

Here, in the state illustrated in FIG. 8, it is assumed that the control unit 11 receives the main sensor change instruction. The control unit 11 receives the main sensor change instruction, and then executes the positioning processing based on the second position management information, that is, the position management information PIG. In FIG. 8, the label 32 at the relative position "155" indicated in the position management information PIG is positioned at the printing position P2, and corresponds to the preceding positioning target label. Therefore, the control unit 11 starts printing on the label 32 after this positioning. The transport unit 17 is then caused to transport the label paper 30 so that the label 32 subsequent to the label 32 after printing, that is, the label 32 at the relative position "115" indicated in the position management information PIG (the subsequent positioning target label) arrives at the printing position P2.

However, in a case where the main sensor change is reflected when the first label 32 detected by the reflection-type optical sensor 21 is positioned at the printing position P2, and the position management information referred to for the positioning processing in the state in FIG. 8 is switched from the position management information PIM to the position management information PIG, the label 32 at the relative position "155" indicated in the position management information PIG is not present as the positioning target label. Instead, the label 32 at the relative position "115" is the positioning target label. This is because the leading edge of the first label 32 detected by the reflection-type optical sensor 21 and the leading edge of the first label 32 detected by the transmission-type optical sensor 20 are deviated from each other by one label. Thus, when the first label 32 detected by the reflection-type optical sensor 21 is positioned at the printing position P2, the label 32 is not present at a position corresponding to the relative position "155" indicated in the position management information PIG. Therefore, the control unit 11 causes the transport unit 17 to transport the label paper 30 so that the label 32 at the relative position "115" indicated in the position management information PIG arrives at the printing position P2. Such processing can be understood as an exception of FIG. 8.

5. Conclusion

According to the present exemplary embodiment as described above, the printing apparatus 10 is capable of performing printing on the printing medium of a plurality of kinds including the label paper 30. On the label paper 30, the plurality of labels 32 are arranged at an interval on the elongated layout paper 31, and the mark 35 is formed for indicating the position of each of the labels 32. The printing apparatus 10 includes the transport unit 17 that transports the printing medium along the transport direction D1, the printing head 19 that performs printing on the printing medium at a predetermined position in the transport direction D1, the transmission-type optical sensor 20 and the reflection-type optical sensor 21 that are arranged at positions upstream of the printing head 19 in the transport direction D1, and the control unit 11 that executes the sensor determination processing and the positioning processing. The transmission-type optical sensor 20 is capable of detecting, as a label position, a boundary between a region of the layout paper 31 where none of the labels 32 are arranged and a region of the labels 32 of the label paper 30, and the reflection-type optical sensor 21 is capable of detecting the mark 35 as a label position. In the sensor determination processing, either of the transmission-type optical sensor 20 or the reflection-type optical sensor 21 is determined as a sensor to be used for detecting a label position (the main sensor) for the positioning processing being transport of the printing medium in which each label 32 is positioned at the printing position P2 of the printing head 19 in the transport direction D1. In the positioning processing, the transport unit 17 is controlled based on a label position for each of the labels 32 detected by the sensor determined in the sensor determination processing, and each of the labels 32 is positioned. In the sensor determination processing, the control unit 11 causes the transport unit 17 to transport the printing medium, causes each of the transmission-type optical sensor 20 and the reflection-type optical sensor 21 to detect a label position, determines one of the sensors that first succeeds in detecting a label position as the first sensor and the other sensor as the second sensor, and causes the transport unit 17 to execute the first transport for transporting the printing medium so that the first label position being the label position detected by the first sensor arrives at the printing position P2. When the first transport is terminated before the second sensor succeeds in detecting a label position during the first transport, the first sensor is determined as the sensor to be used for detecting a label position for the positioning processing. When the second sensor succeeds in detecting a label position during the first transport, either of the first sensor or the second sensor that detects a position closer to the printing position P2 among the first label position and a second label position that is a label position detected by the second sensor, is determined as the sensor to be used for detecting a label position for the positioning processing.

According to the configuration described above, in accordance with the label paper 30 to be used for printing, either of the transmission-type optical sensor 20 or the reflection-type optical sensor 21 that is suitable for detecting a label position on the label paper 30 is automatically determined as the main sensor. In the related art, when setting of a detection method for a label and a sensor to be used for detection and a type of a printing medium to be used do not match with each other, a label cannot be detected for the positioning processing. Such a problem can be prevented. According to the configuration described above, the main sensor is determined in accordance with a relationship between the first label position and the second label position, and the printing position P2. Thus, the labels 32 can be prevented from being transported more than necessary during the positioning processing, specifically, a loss of the labels 32 can be suppressed.

According to the present exemplary embodiment, when the second sensor succeeds in detecting a label position during the first transport, either of the first sensor or the second sensor that is determined as the sensor to be used for detecting a label position for the positioning processing is regarded as the main sensor, and the other sensor is regarded as the sub sensor, the control unit 11 updates and stores the first position management information in accordance with transport of the printing medium, the first position management information being information of a relative position in the transport direction D1 between the main sensor and each label position detected for each of the labels 32 by the main sensor, and the control unit 11 updates and stores the second position management information in accordance with transport of the printing medium, the second position management information being information of a relative position in the transport direction D1 between the sub sensor and each label position detected for each of the labels 32 by the sub sensor. In the positioning processing, the control unit 11 controls the transport unit 17 so that the most downstream label position among the label positions upstream of the printing position P2 in the transport direction arrives at the printing position P2, based on the first position management information. In the positioning processing, when receiving an instruction to change the sensor to be used for detecting a label position for the positioning processing from the main sensor to the sub sensor, the control unit 11 controls the transport unit 17 so that the most downstream label position among the label positions upstream of the printing position P2 in the transport direction arrives at the printing position P2, based on the second position management information.

According to the configuration described above, the control unit 11 stores the first position management information and the second position management information, and hence can switch the positioning processing based on the first position management information to the positioning processing based on the second position management information when the main sensor change instruction is received. With this, redundancy in the processing can be eliminated. Effects are described in detail. In the related art, when a user instructs a change of the detection method for a label, a sensor to be used for the label detection method after the change detects a label position again. For example, when an instruction to change the mark detection method to the gap detection method is given in the state illustrated in FIG. 7, in the related art, the leading edge of the label 32 present upstream of the gap detection position P0 is detected by the transmission-type optical sensor 20 in accordance with transport, and the first positioning processing is executed again with the detection as a reference. Thus, all the labels 32 present downstream of the gap detection position P0 at the time of giving the instruction to change the mark detection method to the gap detection method are transported in an unprinted state, and thus a loss of the label 32 is increased. In view of this, in the present exemplary embodiment, each of the same labels 32 can be subjected to the positioning processing, with the exception, with reference to either of the first position management information or the second position management information, and thus the loss can be suppressed.

Further, according to the present exemplary embodiment, when neither the transmission-type optical sensor 20 nor the reflection-type optical sensor 21 succeeds in detecting a label position in the sensor determination processing even though the transport unit 17 transports the printing medium by a predetermined distance, the control unit 11 causes the transport unit 17 to transport the printing medium in the direction opposite to the transport direction D1 by the second predetermined distance, and determines, as the printing start position, the position of the printing medium facing the printing head 19 when the transport in the opposite direction completes. With this, the sensor determination processing is completed. Further, in the subsequent printing, the control unit 11 is only required to control transport performed by the transport unit 17 with the printing start position as a reference. The second predetermined distance is a distance required for the leading edge of the printing medium to arrive at a position facing the printing head 19.

Alternatively, when neither the transmission-type optical sensor 20 nor the reflection-type optical sensor 21 succeeds in detecting a label position in the sensor determination processing even though the transport unit 17 transports the printing medium by a predetermined distance, the control unit 11 causes the transport unit 17 to transport the printing medium in the direction opposite to the transport direction D1. When either of the transmission-type optical sensor 20 or the reflection-type optical sensor 21 detects the leading edge of the printing medium, the leading edge is determined as the printing start position of the printing medium. With this, the sensor determination processing is completed. The control unit 11 may cause the transport unit 17 to transport the printing medium until the printing start position arrives at the printing position P2, and may control transport by the transport unit 17 with the printing start position as a reference in the subsequent printing.

According to those configurations, even when there is used a printing medium for which neither the transmission-type optical sensor 20 nor the reflection-type optical sensor 21 succeeds in detecting a label position, transport and printing can be performed without a label detection error.

The present exemplary embodiment discloses the printing apparatus and the printing system. Further, in the present exemplary embodiment of the present disclosure, the method executed by the apparatus and the system, and the program 12 for causing the processor to execute the method are disclosed.

The printing control method for performing printing on the printing medium of a plurality of types including the label paper 30 having the plurality of labels 32 arranged at an interval on the elongated layout paper 31 and the mark 35 formed for indicating the position of each of the labels 32, the printing control method includes a transport step for transporting the printing medium in the transport direction D1, a sensor determining step, a positioning step, and a printing step for performing printing on the printing medium with the printing head 19. In the sensor determining step, either of the transmission-type optical sensor 20 or the reflection-type optical sensor 21 is determined as the sensor to be used for detecting a label position for the positioning step being transport of the printing medium in which each label 32 is positioned at the printing position P2 of the printing head 19 arranged at a predetermined position in the transport direction D1. In the positioning step, the transport is controlled based on the label position for each of the labels 32 detected by the sensor determined in the sensor determining step, and positioning is executed for each of the labels. In the sensor determining process, while the printing medium is transported, each of the transmission-type optical sensor 20 and the reflection-type optical sensor 21 detects a label position, one of the sensors that first succeeds in detecting a label position is determined as the first sensor and the other sensor is determined as the second sensor, and the first transport for transporting the printing medium is executed so that the first label position being the label position detected by the first sensor arrives at the printing position P2. When the first transport is terminated before the second sensor succeeds in detecting a label position during the first transport, the first sensor is determined as the sensor to be used for detecting a label position for the positioning step. When the second sensor succeeds in detecting a label position during the first transport, either of the first sensor or the second sensor that detects a position closer to the printing position P2 among the first label position and a second label position that is a label position detected by the second sensor, is determined as the sensor to be used for detecting a label position for the positioning step.

The printing apparatus 10 need not to be a so-called serial inkjet printer in which the printing head 19 is mounted on the carriage 18 that moves in the main scanning direction D2, as described above.

A so-called line type inkjet printer for discharging ink may be assumed, using the printing head 19 including the nozzle rows for each ink color, where the nozzle rows extend in the main scanning direction D2 intersecting the transport direction D1 and are long enough to cover the width of the printing medium. In the line type inkjet printer, the carriage 18 is not required.

Further, the printing type of the printing head 19 is not limited to an inkjet type, and may be an electrographic type, a thermal type, or the like, for example.

What is claimed is:

1. A printing apparatus for performing printing on a plurality of types of printing media including label paper having a plurality of labels arranged at an interval on elongated layout paper and a mark indicating a position of the label and being formed for each of the plurality of labels, the printing apparatus comprising:

a transport unit configured to transport the printing medium in a transport direction;

a printing head configured to perform printing on the printing medium at a predetermined position in the transport direction;

a transmission-type optical sensor and a reflection-type optical sensor being arranged at positions upstream of the printing head in the transport direction, the transmission-type optical sensor being configured to detect, as a label position, a boundary between a region of the layout paper where the label is not arranged at the label paper and a region of the label, the reflection-type optical sensor being configured to detect the mark as a label position; and a control unit configured to execute:

sensor determination processing for determining either of the transmission-type optical sensor or the reflection-type optical sensor as a sensor to be used for detecting a label position for positioning processing, the positioning processing corresponding to transport of the printing medium so that the label is positioned at a printing position of the printing head in the transport direction; and the positioning processing for each of the plurality of labels by controlling the transport unit based on a label position of each of the plurality of labels detected by the sensor determined in the sensor determination processing, wherein in the sensor determination processing, the control unit:

causes each of the transmission-type optical sensor and the reflection-type optical sensor to detect a label position while causing the transport unit to transport the printing medium, and determines a sensor that succeeds in detecting a label position first as a first sensor and the other sensor as a second sensor;

causes the transport unit to perform first transport for transporting the printing medium so that a first label position arrives at the printing position, the first label position being a label position detected by the first sensor;

determines the first sensor as a sensor to be used for detecting a label position for the positioning processing when the first transport is terminated before the second sensor succeeds in detecting a label position during the first transport; and determines, as a sensor to be used for detecting a label position for the positioning processing, the first sensor or the second sensor that detects a position closer to the printing position among the first label position and a second label position that is a label position detected by the second sensor, when the second sensor succeeds in detecting a label position during the first transport.

2. The printing apparatus according to claim 1, wherein when the second sensor succeeds in detecting a label position during the first transport, and one of the first sensor and the second sensor determined as a sensor to be used for detecting a label position for the positioning processing is regarded as a main sensor and the other sensor is regarded as a sub sensor, the control unit:

updates and stores first position management information in accordance with transport of the printing medium, and updates and stores second position management information in accordance with transport of the printing medium, the first position management information being information of a relative position in the transport direction between the main sensor and each label position detected by the main sensor for each of the plurality of labels, the second position management information being information of a relative position in the transport direction between the sub sensor and each label position detected by the sub sensor for each of the plurality of labels; and controls, in the positioning processing, the transport unit based on the first position management information so that a most downstream label position among label positions upstream of the printing position in the transport direction arrives at the printing position, and when an instruction to change a sensor to be used for detecting a label position for the positioning processing from the main sensor to the sub sensor is received, the control unit controls, in the positioning processing, the transport unit based on the second position management information so that a most downstream label position among label positions upstream of the printing position in the transport direction arrives at the printing position.

3. The printing apparatus according to claim 1, wherein in the sensor determination processing, when neither the transmission-type optical sensor nor the reflection-type optical sensor succeeds in detecting a label position even though the transport unit transports the printing medium by a predetermined distance, the control unit causes the transport unit to transport the printing medium in a direction opposite to the transport direction by a second predetermined distance, determines, as a printing start position, a position of the printing medium facing the printing head when transport in the opposite direction completes, and completes the sensor determination processing, in subsequent printing, the control unit controls transport by the transport unit with the printing start position as a reference, and the second predetermined distance is a distance required for a leading edge of the printing medium to arrive at a position facing the printing head.

4. The printing apparatus according to claim 1, wherein in the sensor determination processing, when neither the transmission-type optical sensor nor the reflection-type optical sensor succeeds in detecting a label position even though the transport unit transports the printing medium by a predetermined distance, the control unit causes the transport unit to transport the printing medium in a direction opposite to the transport direction, when either of the transmission-type optical sensor or the reflection-type optical sensor detects a leading edge of the printing medium, the control unit determines the leading edge as a printing start position of the printing medium, and completes the sensor determination processing, and the control unit causes the transport unit to transport the printing medium until the printing start position arrives at the printing position, and in subsequent printing, controls transport by the transport unit with the printing start position as a reference.

5. A printing control method for performing printing on a plurality of types of printing media including label paper having a plurality of labels arranged at an interval on elongated layout paper and a mark indicating a position of the label and being formed for each of the plurality of labels, the printing control method comprising:

a transport step for transporting the printing medium in a transport direction;

a sensor determining step for determining either of a transmission-type optical sensor or a reflection-type optical sensor being arranged at positions upstream of the printing head in the transport direction, as a sensor to be used for detecting a label position for a positioning step, the positioning step corresponding to transport of the printing medium so that the label is positioned at a printing position of a printing head arranged at a predetermined position in the transport direction, the transmission-type optical sensor being configured to detect, as a label position, a boundary between a region of the layout paper where the label is not arranged at the label paper and a region of the label, the reflection-type optical sensor being configured to detect the mark as a label position;

the positioning step for positioning each of the plurality of labels by controlling the transport based on a label position of each of the plurality of labels detected by the sensor determined in the sensor determining step; and a printing step for performing printing on the printing medium with the printing head, wherein in the sensor determining step, each of the transmission-type optical sensor and the reflection-type optical sensor detects a label position while the printing medium is transported, a sensor that succeeds in detecting a label position first is regarded as a first sensor, and the other sensor is regarded as a second sensor, first transport for transporting the printing medium is performed so that a first label position arrives at the printing position, the first label position being a label position detected by the first sensor, when the first transport is terminated before the second sensor succeeds in detecting a label position during the first transport, the first sensor is determined as a sensor to be used for detecting a label position for the positioning step, when the second sensor succeeds in detecting a label position during the first transport, the first sensor or the second sensor that detects a position closer to the printing position among the first label position and a second label position that is a label position detected by the second sensor is determined as a sensor to be used for detecting a label position for the positioning step.

* * * * *